United States Patent [19]

Easter

[11] Patent Number: 5,048,217

[45] Date of Patent: Sep. 17, 1991

[54] OVERLAPPING COVER FOR GUNS WITH EXTENDED MAGAZINES

[76] Inventor: Michael D. Easter, 840 J St., Penrose, Colo. 81240

[21] Appl. No.: 597,862

[22] Filed: Oct. 12, 1990

[51] Int. Cl.[5] ..... F41A 35/02

[52] U.S. Cl. ..... 42/96

[58] Field of Search ..... 42/96

[56] References Cited

U.S. PATENT DOCUMENTS

| | | | |
|---|---|---|---|
| 35,456 | 8/1862 | Leverich | 42/96 |
| 2,599,689 | 6/1952 | Brelsford | 42/96 |
| 2,872,960 | 2/1959 | Kolpin | 42/96 |
| 4,858,361 | 8/1989 | White | 42/96 |
| 4,860,479 | 8/1989 | Easter | 42/96 |

FOREIGN PATENT DOCUMENTS

| | | | |
|---|---|---|---|
| 22346 | 6/1921 | France | 42/96 |
| 23895 | 12/1914 | United Kingdom | 42/96 |

*Primary Examiner*—Charles T. Jordan
*Attorney, Agent, or Firm*—Klaas & Law

[57] ABSTRACT

A new protective covering apparatus (6) for guns with high capacity extended magazines providing protection for the receiver (18), magazine (22) and trigger guard (28) while the gun is being carried in the field or stored. The covering apparatus (6) is comprised of a single unit of flexible water repellent material having sufficient size to envelope the entire receiver area of a gun (FIG. 4), to include the magazine (22), receiver (18) and trigger guard (28). Attached to the front end of flaps (12) and (14) of protective covering (6) are releasable fasteners (8A) and (8B) providing means for attaching and sealing the front end of flaps (12) and (14) about the hand guard (20). Attached to the rear of outer flap (12) are releasable fasteners (10A) and (10B) for retaining and sealing the rear edges (12C) and (14C) of flaps (12) and (14) about the gun's butt stock (26) and pistol grip (24). Attached beneath flaps (12) and (14) is pouch (16) providing protection for the gun's extended magazine (22). In attaching protective covering (6) to the gun, pouch (16) is slid up over magazine (22), then inner flap (14) is wrapped over the top of receiver (18) followed by the wrapping of outer flap (12) in the reverse direction, back over the receiver (18). Releasable fasteners (8A) and (8B) are connected together around hand guard (20) in the front, while releasable fasteners (10A) and (10B) are connected in the rear by passing the strap portion of (10A) between the butt stock (26) and the piston grip (24).

5 Claims, 2 Drawing Sheets

OVERLAPPING COVER FOR GUNS WITH EXTENDED MAGAZINES

BACKGROUND—FIELD OF INVENTION

This invention relates to a protective covering device for guns and more particularly to a new overlapping protective cover providing protection for guns with extended high capacity magazines while being carried in the field or stored.

BACKGROUND—DESCRIPTION OF PRIOR ART

Heretofore protective coverings for guns in general have been primarily confined to providing protection only when the gun is not being used. These coverings envelope the gun in it's entirety providing protection for the whole gun, consequently making quick access for firing out of the question. Furthermore, if a person did remove a full length cover in order to fire the gun, he would have to drop the cover on the ground as no means are provided to keep the cover attached to the gun.

This application is generally related to my prior U.S. Patent, U.S. Pat. No. 4,860,479 granted Aug. 29, 1989 for Wraparound Cover For Guns During Field Use. This protective cover used a single flap of fabric, attached by one end to a telescopic sight, and wrapped around the rifle more than 360 degrees in order to protect the action and telescopic sight. Even if the elastic were used, there is no way, even with extreme modification, this design could be effectively used on a rifle with an extended high capacity magazine. Nor was such an application suggested.

Applicant is aware of U.S. Pat. No. 2,599,689—Brelsford Jr., U.S. Pat. No. 35,456—Leverich, U.S. Pat. No. 2,872,960—Kolpin.

In the case of Leverich, where a fabric sleeve having elastic in it's ends is pulled over the action area, there is no suggestion at all of applicant's invention.

Looking at Brelsford's cover, one sees an early and unsuccessful attempt at covering a telescopic sight and rifle action with fabric and clamps. Again, no suggestion of applicant's invention.

It has been over 25 years now since American armies started using, in large numbers, the type of rifle my invention is designed to protect. The pictorial illustrations contained herein, particularly FIG. 4, clearly suggest why no one has been successful in inventing a cover that provides protection for the rifle while being used in the field. The irregular, uneven, and ungainly profile of the midsection of this rifle have precluded people skilled in the art from inventing such a cover by combining obvious features of prior art. The need for a protective covering for such a rifle is shown by the documented accounts where these guns have malfunctioned during combat as a result of sand, mud, ice or debris entering the receiver and magazine area of the gun. On at least one occasion, a soldier frantically disassembled his rifle for cleaning, and was summarily shot and killed by the enemy. Also, a large number of these type rifles are in use by civilian S.W.A.T. teams, as well as hunters and sportsmen in general.

It is at the request of a branch of the U.S. armed forces that applicant has invented the present invention. Therefore, there exists a need for a cover that provides protection for the critical midsection of a gun, including the action, ejection port, trigger, and magazine. Moreover, the cover should be quick and easy to open, allowing the gun to be fired when needed while simultaneously remaining attached to the gun preventing loss or droppage. It would be a great advantage if the pistol grip of the gun were left exposed for use when the cover is fully closed. A still further object is that the cover be easily opened and closed by a person wearing gloves. Additional features of easy attachment to, and detachment from the gun are also desirable. Another objective is to have both the left and right sides of the receiver exposed when the cover is initially opened. And a still further objective is the ability to open the cover far enough, while remaining attached, to allow the unrestricted removal and replacement of the gun's magazine. Yet another object would be a cover that could be easily removed from the gun and conveniently carried in a clothing pocket. Other objectives of the invention would be to provide a cover that is lightweight, durable, inexpensive and attractive.

Other objectives and advantages of my invention will become apparent from the following description and the accompanying drawings.

DESCRIPTION OF THE DRAWINGS

Presently preferred and illustrative embodiments of the invention are shown in the accompanying drawings wherein.

DRAWING REFERENCE NUMERALS

Figure 1:
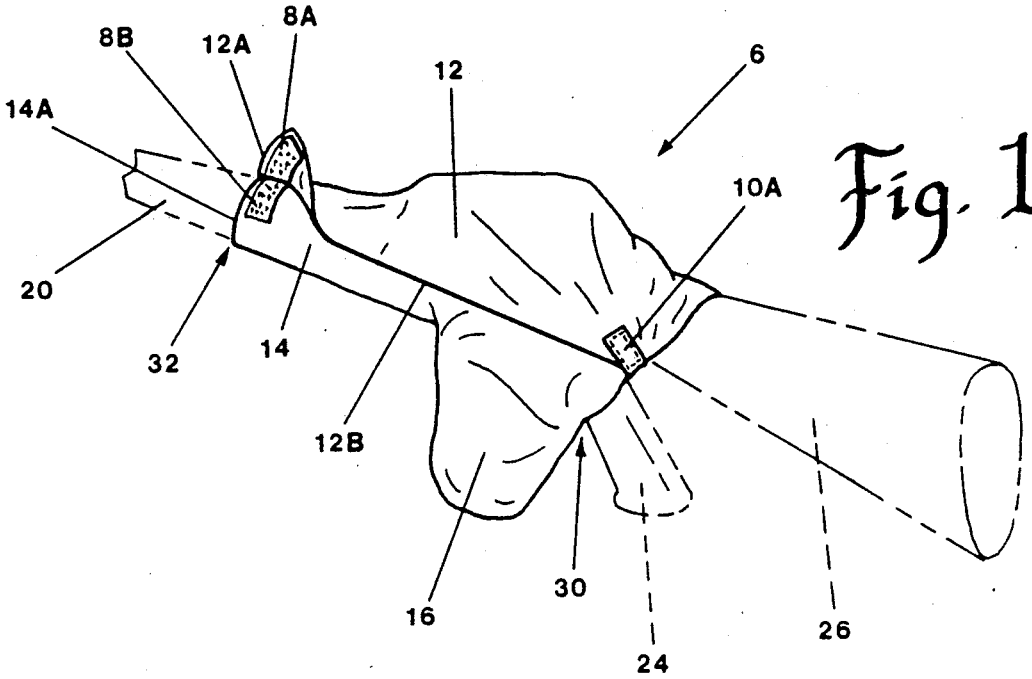
FIG. 1 is an illustrative perspective view of the protective cover of the present invention in an essentially closed position on one type of gun.
Figure 2:
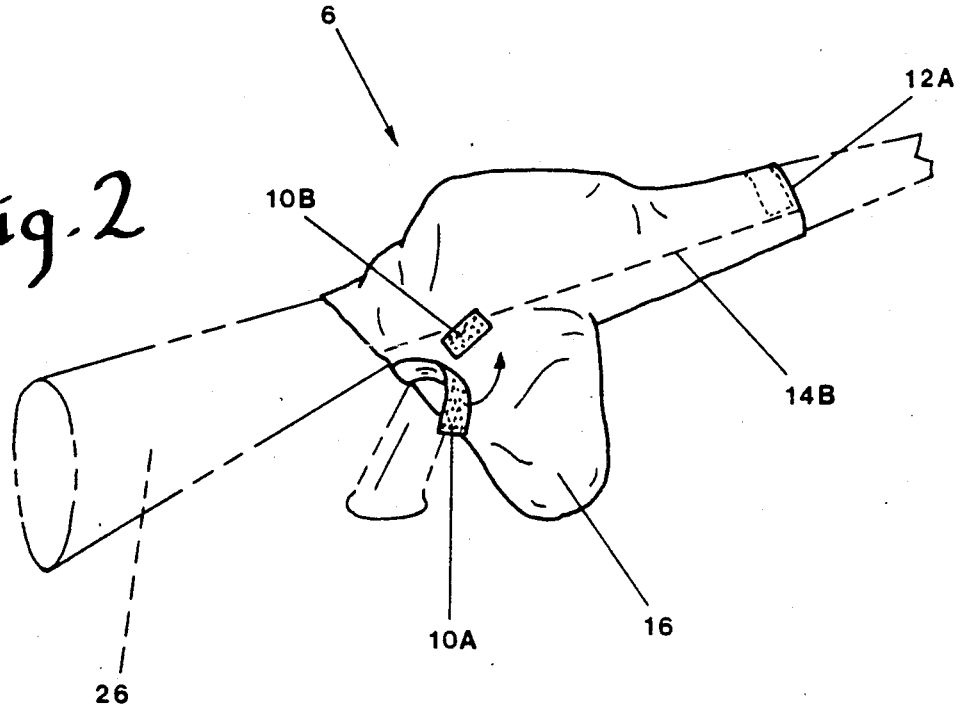
FIG. 2 is another illustrative perspective view of the protective cover of FIG. 1.

6 protective covering
8A Velcro fastener
8B Velcro fastener
10A Velcro fastener
10B Velcro fastener
12 outer flap
12A A outer flap front edge
12B outer flap side edge
12C outer flap rear edge
14 inner flap
14A inner flap front edge
14B inner flap side edge
14C inner flap rear edge
16 magazine pouch
18 receiver area
20 rifle hand guard
22 magazine
24 pistol grip
26 butt stock
28 trigger guard
30 beginning of seam
32 end of seam
34 magazine well

DETAILED DESCRIPTION OF INVENTION

As shown in FIGS. 1 thru 4, the present invention is adapted for use on a widely used military and civilian type gun, comprising a hand guard 20, receiver area 18, detachable magazine 22, trigger guard 28, pistol grip 24, and butt stock 26. The location and size of these basic components may vary on other rifles.

In general, the covering device comprises a covering means 6, made of flexible collapsible water resistant cloth-like material for and surrounding the entire receiver 18, and magazine 22 of a rifle.

As shown in FIGS. 1 thru 4, the present invention is adapted for use on a standard military rifle having an extended magazine 22, and a pistol grip 24. The gun covering device 6, made of flexible water resistant cloth-like material with a pocket-like pouch 16, forming the lower portion. Above pouch 16 is the upper portion consisting of inner flap 14, and outer flap 12. Flaps 12 and 14 are sewn together with a seam extending from the top front of pouch 16 out to the front end of cover 6, at point 32. Moreover, two pieces of fabric having same shape are sewn together with a seam that begins at point 30 (FIG. 1) traveling downward around pouch 16 and along the bottom of the fabric covering handguard 20, ending at the front of the cover at point 32, thereby forming pouch 16 and joining flaps 12 and 14. Fabric gathering seams can be used on both flaps 12 and 14 in order to create a more form fitting and effective protective covering. The overall size being sufficient for pouch 16 to contain magazine 22 and allow flaps 12 and 14 to be wrapped in opposite directions over the top and down the side of receiver 18, while extending onto butt stock 26 in the rear and onto hand guard 20, in the front. The distance that the front end of cover 6 extends forward along hand guard 20 should be sufficient to allow pouch 16 to be pulled down and forward off of magazine 22 when flaps 12 and 14 are in the open position (FIG. 3) and Velcro fasteners 8A and 8B are joined around hand guard 20 adjacent to flap front edges 12A and 14A. Velcro fastener 8A is provided on outer flap 12, and Velcro fastener 8B is provided on inner flap 14. Velcro fasteners 1OA and 1OB are provided at the rear of outer flap 12. Velcro strap 1OA is attached to the rear corner of outer flap 12 (FIGS. 1 and 3) and is of sufficient length and width to slideably pass between pistol grip 24 and butt stock 26 and overlap Velcro fastening means 1OB, FIG. 2. The Velcro fastening means may be substituted by other fastening means such as snaps or hooks.

From the above description of protective covering 6, it should be apparent that it becomes a simple procedure to use cover 6 on a gun with an extended magazine.

Attach cover 6 to the rifle by sliding pouch 16 over magazine 22 until point 30 is up against the pistol grip and point 32 is brought into contact with the bottom of hand guard 20. Next, wrap inner flap 14, over the top of receiver 18, and hand guard 20, so that the side edge of flap 14, 14B is approximately as shown by dashed line 14B, FIG. 2. Now pull flap 12 up and over the rifle in the opposite direction. Wrap the front corner of flap 12 snugly over the corresponding corner of flap 14 thus mating Velcro fastening portion 8A with 8B. At the rear corner of flap 12, slide the free end of Velcro strap 1OA between pistol grip 24 and butt stock 26 wrapping it around to and snugly mating with Velcro fastener 1OB. This closing and fastening of strap lOA simultaneously retains the rear of flap 12 and seals the rear edges of both flaps of cover 6 about butt stock 26 and pistol grip 24. The foregoing procedure completely closes protective covering 6 about the critical components of the rifle's midsection in a new and novel way.

Now the user can store the gun or carry it in the field and have confidence the gun will function as intended even when subjected to the worst weather and element conditions.

When the time arises to open protective cover 6, a truly unexpected advantage becomes evident. The normal carrying position of the rifle is in front of the user's stomach area with the rifle pointing to the left and the user having his left hand under hand guard 20 while his right hand grasps the pistol grip. In this position, the user's right hand is actually touching Velcro strap 10A, providing him with the quickest start possible for opening up cover 6 and firing the rifle.

Figure 3:
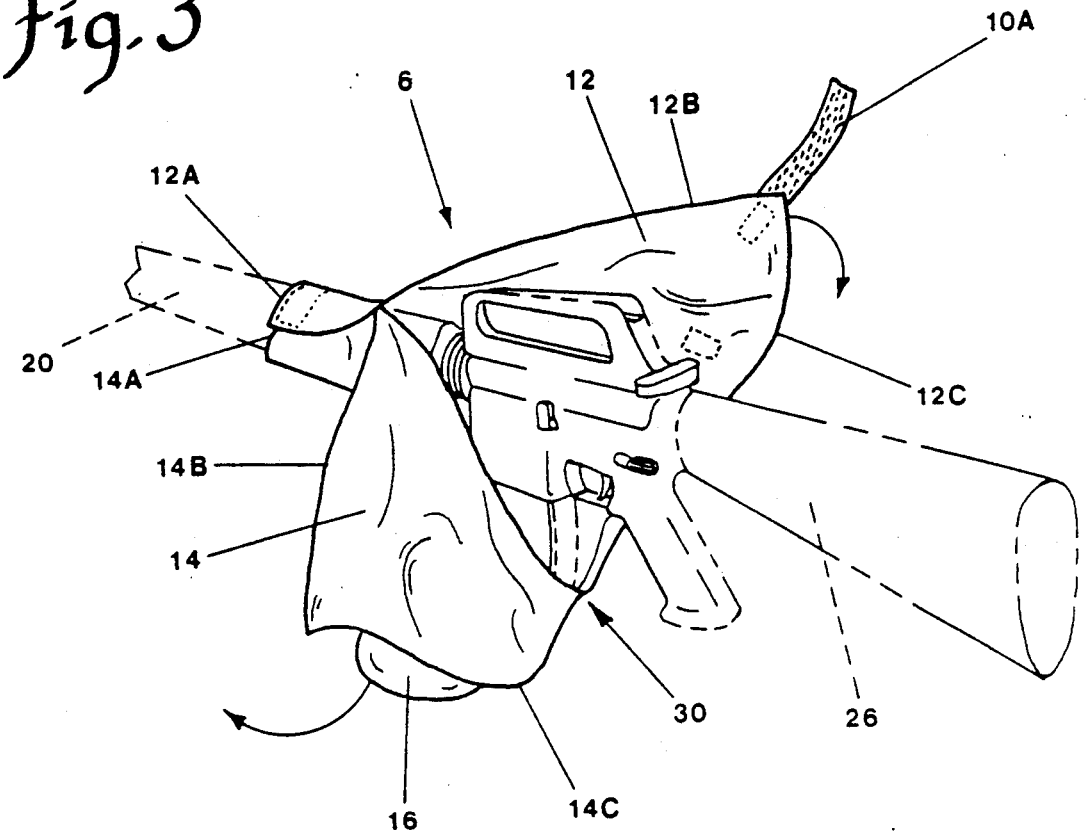
FIG. 3 is a perspective view of the protective cover in a partially opened state.

Upon the initial laying back and off of flaps 12 and 14, they hang down in the attitude illustrated by flap 14 in FIG. 3, allowing the rifle to be fired, as intended, by completely exposing both sides of receiver 18, to include the ejection port, safety, trigger and magazine release. However, an unexpected advantage occurs, in that, pouch portion 16 of cover 6 is still covering and protecting the lower portion of magazine 22. This unexpected occurrence is very desirable when the user is laying on the ground, as the bottom of the magazine is the first part of the rifle to come in contact with the earth when being fired in the prone position. Furthermore, in the event all of the shells within the magazine are fired, the magazine can be ejected from the rifle and caught in pouch 16, allowing for rapid replacement in the rifle with a fully loaded magazine, while having the expended magazine protectively retained in the covers pouch. An additional novel feature is realized when cover 6 is closed on a rifle not having a magazine inserted in the magazine well. The now empty and loose pouch 16 can simply be stuffed up into the magazine well thereby preserving the snug and trim appearance of cover 6.

To open cover 6 far enough to allow removal of magazine 22 from magazine well 34, simply grasp the bottom of pouch 16, pulling downward and forward simultaneously. This action serves to spread even further apart flaps 12 and 14 in the area immediately behind Velcro fasteners 8A and 8B, causing the bulk of cover 6 to hang down beneath hand guard 20, well in front of receiver 18 and magazine 22.

It should be pointed out here that the considerable distance forward on hand guard 20 occupied by cover 6 is necessitated by the non-obvious geometric requirements necessary for cover 6 to be opened in the aforementioned manner.

Figure 4:
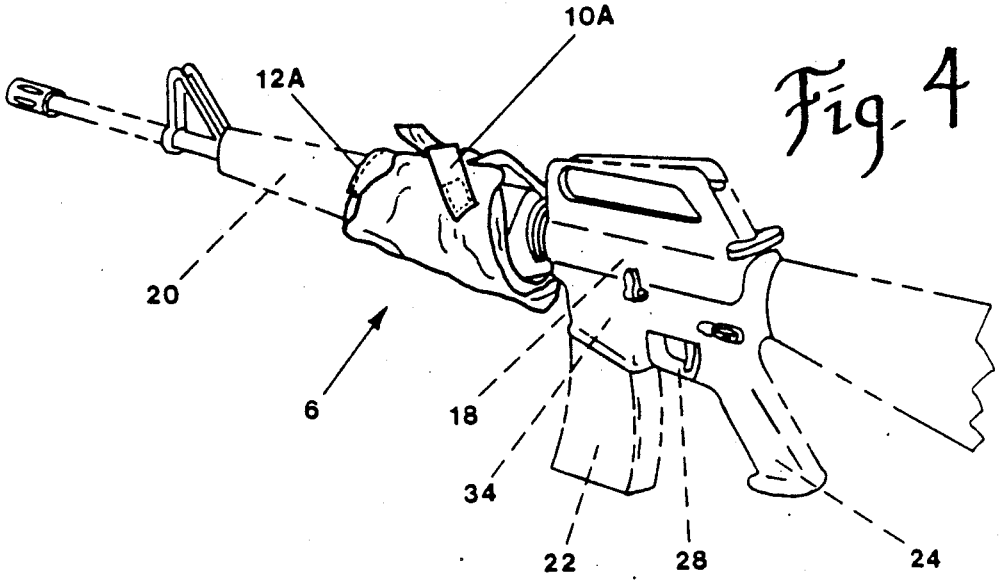
FIG. 4 is a perspective view of the rifle, showing the cover in a fully stored state while remaining attached to the hand guard of the gun.

A further unexpected and novel feature of this invention is pictorially illustrated in FIG. 4. By purposefully folding and wrapping, cover 6 can be neatly stored out of the way on hand guard 20 by using Velcro fasteners 10A and 1OB. Furthermore, such handy storage is enjoyed without opening or changing Velcro portions 8A and 8B. Of course, it is a simple matter to remove it entirely from the rifle and stuff it into a clothing or pack pocket until needed.

A still further unexpected advantage of applicant's cover pertains to the taper of hand guard 20. As shown in all Figures, hand guard 20 becomes larger in diameter the closer it gets to receiver 18. This subtle feature seems insignificant at first but, when cover 6 is actually attached, a most desirable feature becomes evident. When Velcro strap 1OA is pulled around and fastened to Velcro 1OB, FIG. 1, the side edge 12B of flap 12 is pulled taut from the front of cover 6, surrounding hand guard 20, back to Velcro strap 1OA. Keeping side edge 12B taut is, of course, most desirable and made possible when you realize that the forward end of cover 6 only becomes tighter and more resistant when flap 12 is being pulled rearward by the attachment of Velcro portions 1OA and 1OB.

The contour fitting shape of cover 6 provides another unexpected bonus for the user in the angular area formed where pouch 16 meets with the fabric extending forward along hand guard 20. It is precisely in this area where a rifleman sometimes likes to grasp the rifle and carry it in one hand with the barrel pointing downward. The forward portions of flaps 12 and 14 were designed to snugly wrap around hand guard 20 from receiver 18 and magazine well 34 outward in order to prevent dirt and moisture from entering same, however, this also nicely preserves the users option for conveniently carrying her gun.

It will be clear to those skilled in the art that many variations of my invention are possible within the spirit and scope of my invention. Accordingly, as I do not wish to be bound by the specific description of the preferred embodiment described above, the scope of the invention should be determined by the claims which follow, and their legal equivalents:

I claim:

1. A protective covering apparatus for guns using an extended magazine positioned beneath the receiver area comprising:

(a) a single flexible cover unit made from a sheet of flexible material including a pouch portion connected to two flap portions and being of sufficient size and shape to enclose the magazine, receiver and trigger of a gun when placed in a closed covering position;

(b) said pouch portion having a mitten-like shape providing a cavity therewithin of a size and shape such as to receive the entire extending portion of the gun's magazine;

(c) attachment means for attaching the front edge of said flap portions to the hand guard area of a gun whereby the front edges of said flap portions overlap each other and attach said cover unit to the gun when said cover unit is in an open non-covering position; and also fixedly holding the front edges of said flap portions when said cover unit is in a closed covering position whereat the receiver, magazine and trigger of the gun are completely covered; and (d) attachment means associated with rear edge of said flap portion means for securing and sealing about the butt stock and pistol grip area of the gun whereby said pouch means envelopes the gun's magazine and said flap portion means are overlapped one over another over the top and down the side of the gun's receiver causing one side edge of said flap portions to be positioned along each side of the gun's receiver.

2. The covering apparatus of claim 1 wherein said attachment means associated with the rear edge of said flap portion means and the front edge of said flap portion means is comprised of releasable connector means being fixedly attached to said flexible material.

3. The covering apparatus of claim 2 wherein said releasable connector means comprises hook and loop connecting devices.

4. The invention as defined in claim 1 wherein said attachment means associated with said rear edge of said flap portion means comprises at least one strap member attached to and extending from said rear edge of said flap portion; and having length sufficient to provide a connection from one side of the gun to the opposite side while passing beneath the gun's butt stock.

5. The invention as defined in claim 4 wherein said attachment means further comprises a first releasable connector means on said strap member and a second releasable connector means on said flap portion for releasably connecting said strap member to said flap portion in a wrapped relationship beneath the forward portion of the butt stock.

* * * * *